US011649527B2

(12) United States Patent
Kim et al.

(10) Patent No.: US 11,649,527 B2
(45) Date of Patent: May 16, 2023

(54) METAL ALLOYS FOR HYDRAULIC APPLICATIONS

(71) Applicant: Robert Bosch GmbH, Stuttgart (DE)

(72) Inventors: Soo Kim, Cambridge, MA (US); Michael Weathersbee, Ware Shoals, SC (US); Charles Tuffile, Swansea, MA (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/152,168

(22) Filed: Jan. 19, 2021

(65) Prior Publication Data

US 2022/0228238 A1 Jul. 21, 2022

(51) Int. Cl.
*C22C 9/02* (2006.01)

(52) U.S. Cl.
CPC ..... *C22C 9/02* (2013.01)

(58) Field of Classification Search
CPC .... C22C 9/02; C22C 9/06; C22C 1/06; C22C 13/00; C22C 13/02; H01L 23/49579; H01L 2924/0002; C22F 1/08; F16C 33/121; F16C 2204/10; H05K 3/3463; H05K 3/3468; H05K 3/3489; B23K 35/262

See application file for complete search history.

(56) References Cited

U.S. PATENT DOCUMENTS 3,773,505 A 11/1973 Nesslage et al.
4,191,564 A 3/1980 Hirao et al.
5,188,799 A 2/1993 Mori et al.
8,070,893 B2 12/2011 Era et al.
2006/0104855 A1 5/2006 Rothschild
2009/0317290 A1 12/2009 Ababneh et al.
(Continued)

FOREIGN PATENT DOCUMENTS

DE 28 30 459 A1 5/1979
JP 2001107106 A * 4/2001

OTHER PUBLICATIONS (D2)—Kupfer-Zink-Legierungen (Messing und Sondermessing), Veröffentlichung des Deutschen Kupferinstituts, Informationsdruck i.5, Auflage Mar. 2007.

(Continued)

*Primary Examiner* — Anthony M Liang
*Assistant Examiner* — Danny N Kang
(74) *Attorney, Agent, or Firm* — Brooks Kushman P.C.

(57) ABSTRACT

A wear resistant hydraulics system includes a first copper-based alloy having a formula (I), $Cu_aSn_bZn_cM_d$, where M is a combination of up to six transition metals, metalloids, and/or alkali metals, a is any number between 0.50 and 0.93, b is any number between 0.00 and 0.07, c is any number between 0.00 and 0.40, and d is any number between 0.01 and 0.40, and a second copper-based alloy including at least 50 wt. % of Cu, based on the total weight of the alloy; and at least one compound of formula (II) $A_xB_y$, where A is Cu, Sn, or Zn, B is Co, Cr, In, Mn, Mo, Ni, Rb, Sb, Te, or Ti, x is any number between 1 and 53, and y is any number between 1 and 16, the first or second alloy having a bulk modulus $K_{VRH}$ value of about 70 to 304 GPa.

13 Claims, 3 Drawing Sheets

(56) References Cited

U.S. PATENT DOCUMENTS

| | | | | |
|---|---|---|---|---|
| 2018/0112302 | A1* | 4/2018 | Grensing | C22C 9/06 |
| 2020/0232068 | A1* | 7/2020 | Funaki | F16C 33/122 |
| 2021/0078073 | A1* | 3/2021 | Mack | B22F 1/05 |

OTHER PUBLICATIONS (D3)—Kupfer-Zinn- und Kupfer-Zinn-Zank-Legierungen (Zinnbronzen), Veröffentlichung des Deutschen Kupferinstituts, Informationscruck i.25, Auflage Dec. 2004.
(D4)—Kupfer-Aluminum-Legierungen, Veröffentlichung des Deutschen Kupferinstituts, Informationsdrunk i.6, Auflage Mar. 2010.
(D5)—Kupfer-Nickel-Legierungen, Veröffentlichung des Deutschen Kupferinstituts, Auflage 2020.
3rd Party Submission Notice, dated Nov. 2, 2022, submitted in corresponding German application 10 2022 200 238.5 (no English translation).

* cited by examiner

METAL ALLOYS FOR HYDRAULIC APPLICATIONS

TECHNICAL FIELD

The present disclosure relates to metal alloys, with reduced or no content of lead, configured for hydraulic applications and methods of identifying and producing the same.

BACKGROUND

The discovery of metal alloys such as bronze and brass enabled humans to technologically advance because the alloy materials were harder and more durable than pure metals. As time went on, various combinations of metals were identified and used to further improve desirable properties of bronze and brass. But many of the improvements included toxic materials such as arsenic or lead which are problematic with respect to human populations as well as the environment.

SUMMARY

In one or more embodiments, a wear resistant hydraulics system is disclosed. The system includes a first copper-based alloy having a formula (I):

$$Cu_aSn_bZn_cM_d \quad (I)$$

where
M is a combination of up to six transition metals, metalloids, and/or alkali metals,
a is any number between 0.50 and 0.93,
b is any number between 0.00 and 0.07,
c is any number between 0.00 and 0.40, and
d is any number between 0.01 and 0.40.

The system may also include a second copper-based alloy including at least 50 wt. % of Cu, based on the total weight of the alloy, and at least one compound of formula (II):

$$A_xB_y \quad (II)$$

where
A is Cu, Sn, or Zn,
B is Co, Cr, In, Mn, Mo, Ni, Rb, Sb, Te, or Ti,
x is any number between 1 and 53, and
y is any number between 1 and 16.

The first or second alloy may have a bulk modulus $K_{VRH}$ value of about 70 to 304 GPa. M may be Sb, Te, Co, Rb, Mo, In, W, Tl, Al, Fe, Mn, Ni, Pb, Si, or their combination. The first and/or second copper-based alloy may be doped with Ni, Co, W, or a combination thereof. Doping may be up to about 2 wt. %, based on the total weight of the alloy. c may be 0.02. B may be Co, In, or Ni. The first alloy may have formula $Cu_{0.93}Sn_{0.06}W_{0.06}$. The at least one compound of formula (II) may be $SnNi_3$. The hydraulics system may include an axial piston pump.

In another embodiment, a copper-based alloy is disclosed. The alloy includes at least 50 wt. % of Cu, based on the total weight of the alloy and at least one compound of formula (II):

$$A_xB_y \quad (II)$$

where
A is Cu, Sn, or Zn,
B is Co, Cr, In, Mn, Mo, Ni, Rb, Sb, Te, or Ti,
x is any number between 1 and 53, and
y is any number between 1 and 16.

B may be Co, In, or Ni. The at least one compound of formula (II) may be $SnNi_3$. The at least one compound of formula (II) may include two different compounds. The two different compounds may have B=Ni. The alloy may have a bulk modulus $K_{VRH}$ value of about 70 to 304 GPa. The at least one compound of formula (II) may include a mixture of compounds, at least one of which has A=Sn and at least one of which has A=Zn.

In an alternative embodiment, a copper-based alloy is disclosed. The alloy has a formula (I):

$$Cu_aSn_bZn_cM_d \quad (I)$$

where
M is at least one of Sb, Te, Co, Rb, Mo, In, W, or Tl, Al, Fe, Mn, Ni, Pb, or Si,
a is any number between 0.50 and 0.93,
b is any number between 0.00 and 0.07,
c is any number between 0.00 and 0.40, and
d is any number between 0.01 to 0.40.

The copper-based alloy may be doped with Ni, Co, W, or a combination thereof. d may be 0.02, c may be 0.00, and M may be Mo, In, Sb, or Te. The alloy may have a bulk modulus $K_{VRH}$ value of about 70 to 304 GPa.

DETAILED DESCRIPTION

Figure 1:
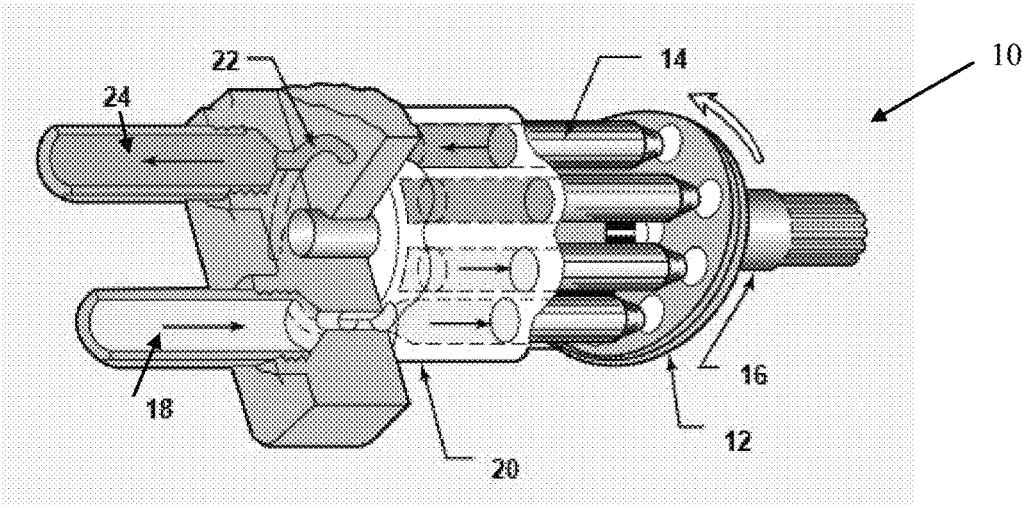
FIG. 1 is a schematic depiction of a non-limiting example of a hydraulics system of an axial piston pump.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Except in the examples, or where otherwise expressly indicated, all numerical quantities in this description indicating amounts of material or conditions of reaction and/or use are to be understood as modified by the word "about" in describing the broadest scope of the disclosure. Practice within the numerical limits stated is generally preferred. Also, unless expressly stated to the contrary: percent, "parts of," and ratio values are by weight; the description of a group or class of materials as suitable or preferred for a given purpose in connection with the disclosure implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed.

The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

It must also be noted that, as used in the specification and the appended claims, the singular form "a," "an," and "the" comprise plural referents unless the context clearly indicates otherwise. For example, reference to a component in the singular is intended to comprise a plurality of components.

As used herein, the term "substantially," "generally," or "about" means that the amount or value in question may be the specific value designated or some other value in its neighborhood. Generally, the term "about" denoting a certain value is intended to denote a range within ±5% of the value. As one example, the phrase "about 100" denotes a range of 100±5, i.e. the range from 95 to 105. Generally, when the term "about" is used, it can be expected that similar results or effects according to the disclosure can be obtained within a range of ±5% of the indicated value. The term "substantially" may modify a value or relative characteristic disclosed or claimed in the present disclosure. In such instances, "substantially" may signify that the value or relative characteristic it modifies is within ±0%, 0.1%, 0.5%, 1%, 2%, 3%, 4%, 5% or 10% of the value or relative characteristic.

It should also be appreciated that integer ranges explicitly include all intervening integers. For example, the integer range 1-10 explicitly includes 1, 2, 3, 4, 5, 6, 7, 8, 9, and 10. Similarly, the range 1 to 100 includes 1, 2, 3, 4, . . . 97, 98, 99, 100. Similarly, when any range is called for, intervening numbers that are increments of the difference between the upper limit and the lower limit divided by 10 can be taken as alternative upper or lower limits. For example, if the range is 1.1. to 2.1 the following numbers 1.2, 1.3, 1.4, 1.5, 1.6, 1.7, 1.8, 1.9, and 2.0 can be selected as lower or upper limits.

In the examples set forth herein, concentrations, temperature, and reaction conditions (e.g., pressure, pH, flow rates, etc.) can be practiced with plus or minus 50 percent of the values indicated rounded to or truncated to two significant figures of the value provided in the examples. In a refinement, concentrations, temperature, and reaction conditions (e.g., pressure, pH, flow rates, etc.) can be practiced with plus or minus 30 percent of the values indicated rounded to or truncated to two significant figures of the value provided in the examples. In another refinement, concentrations, temperature, and reaction conditions (e.g., pressure, pH, flow rates, etc.) can be practiced with plus or minus 10 percent of the values indicated rounded to or truncated to two significant figures of the value provided in the examples.

For all compounds expressed as an empirical chemical formula with a plurality of letters and numeric subscripts (e.g., $CH_2O$), values of the subscripts can be plus or minus 50 percent of the values indicated rounded to or truncated to two significant figures. For example, if $CH_2O$ is indicated, a compound of formula $C_{(0.8\text{-}1.2)}H_{(1.6\text{-}2.4)}O_{(0.8\text{-}1.2)}$. In a refinement, values of the subscripts can be plus or minus 30 percent of the values indicated rounded to or truncated to two significant figures. In still another refinement, values of the subscripts can be plus or minus 20 percent of the values indicated rounded to or truncated to two significant figures.

As used herein, the term "and/or" means that either all or only one of the elements of said group may be present. For example, "A and/or B" means "only A, or only B, or both A and B". In the case of "only A," the term also covers the possibility that B is absent, i.e. "only A, but not B".

It is also to be understood that this disclosure is not limited to the specific embodiments and methods described below, as specific components and/or conditions may, of course, vary. Furthermore, the terminology used herein is used only for the purpose of describing particular embodiments of the present disclosure and is not intended to be limiting in any way.

The term "comprising" is synonymous with "including," "having," "containing," or "characterized by." These terms are inclusive and open-ended and do not exclude additional, unrecited elements or method steps.

The phrase "consisting of" excludes any element, step, or ingredient not specified in the claim. When this phrase appears in a clause of the body of a claim, rather than immediately following the preamble, it limits only the element set forth in that clause; other elements are not excluded from the claim as a whole.

The phrase "consisting essentially of" limits the scope of a claim to the specified materials or steps, plus those that do not materially affect the basic and novel characteristic(s) of the claimed subject matter.

With respect to the terms "comprising," "consisting of," and "consisting essentially of," where one of these three terms is used herein, the presently disclosed and claimed subject matter can include the use of either of the other two terms.

The term "one or more" means "at least one" and the term "at least one" means "one or more." The terms "one or more" and "at least one" include "plurality" as a subset.

The description of a group or class of materials as suitable for a given purpose in connection with one or more embodiments implies that mixtures of any two or more of the members of the group or class are suitable. Description of constituents in chemical terms refers to the constituents at the time of addition to any combination specified in the description, and does not necessarily preclude chemical interactions among constituents of the mixture once mixed. First definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

Perhaps the most famous of metal alloys are bronze and brass. Bronze was discovered and developed by various cultures at least 6.5 thousand years ago. Similarly, various forms of brass have been known since ancient times in different parts of the world. Their applications have been wide, from sculpting to coin making, machinery, and architectural applications.

While both bronze and brass vary in composition, typical modern bronze is an alloy of copper and tin and contains about 88 wt. % copper (Cu) and 12 wt. % tin (Sn), based on the total weight of the bronze alloy. Brass is an alloy of copper and zinc (Zn) in various proportions. Due to their physical and/or mechanical properties, bronze and brass are more suitable for certain applications than other metals and alloys. Specific applications then dictate specific composition of the bronze and brass. Example applications utilizing bronze and brass may be hydraulics or technology concerned with the conveyance of liquids through pipes and channels, especially as a source of mechanical force or control. Non-limiting example applications, systems, or components include hydraulic drives, cylinders, rams, cables, presses, pumps. A non-limiting example may be an axial piston for hydraulic pump depicted in FIG. 1.

In FIG. 1, an axial piston pump assembly is shown. The piston pump 10 is a rotary device using the principle of reciprocating pistons to produce fluid flow. The piston pump 10 varies displacement by changing angle of a swashplate 12. The pump has more than one piston 14. The piston 14 and cylinder 20 assembly of the pump mechanism rotates with the drive shaft 16 to generate the reciprocating motion which draws fluid from an inlet 18 into a cylinder 20 via a port plate slot 22 and then expels the fluid to the outlet 24 via the slot 22, producing flow.

In the hydraulic applications, lead-containing brass and bronze have been traditionally used because of their high wear resistance, machinability, and atmospheric corrosion resistance. The machinability of brass and bronze may be increased by the addition of lead (Pb) because lead acts as a microscopic chip breaker and tool lubricant. Lead also provides pressure tightness by sealing shrinkage pores. For example, there are low, medium, and high leaded brasses, with lead contents of up to about 3.5 wt. %.

While leaded metal alloys have their advantages, federal and state governments have established regulations to limit human chemical exposure to lead. The primary issue is that presence of lead in the brass results in risks due to the potential (1) ingestion of brass particles/dust generated during abrasive operation or during machining and (2) inhalation of lead fumes from a melting operation such as welding.

Hence, attempts have been made to develop lead-free brass, in which lead may be replaced with Si, Bi, or mixed copper alloys (e.g., Zn, Fe, Ni, etc.). But typically, even brass labeled as "lead-free" may contain trace amounts of lead; typically, no more than the 0.25% mandated by the law.

Furthermore, Bi is one of the most likely candidate elements to replace toxic Pb in brass and bronze alloys. While Bi can enhance the oxidation resistance of Cu-based metal alloys, it is likely that Bi segregates into a separate microstructure since it is not very soluble. These brittle Bi impurities, even in small amounts, may cause fractures in the copper metal alloys, which is undesirable.

Therefore, need still exists for copper-based alloys with low (less than 3 wt. %) or no content of lead, which at the same time have excellent corrosion resistance, machinability and other mechanical properties such as wear resistance which may be used to produce copper-based hydraulic parts.

In one or more embodiments disclosed herein, a copper-based alloy is disclosed. The alloy may have reduced content of Pb in comparison to typical brass or bronze alloys for hydraulic applications. The reduced content may be less than or equal to 3 wt. %, based on the total weight of the alloy. The reduced content may be about, at most about, or no more than about 3.0, 2.9, 2.8, 2.7, 2.6, 2.5, 2.4, 2.3, 2.2, 2.1, 2.0, 1.9, 1.8, 1.7, 1.6, 1.5, 1.4, 1.3, 1.2, 1.1, 1.0, 0.9, 0.8, 0.7, 0.6, 0.5, 0.4, 0.3, 0.2, 0.1, or 0.0 wt. %, based on the total weight of the alloy. The alloy may be free or Pb. The alloy may be substantially free of Pb or contain up to 0.1 wt. % of Pb, based on the total weight of the alloy. The alloy may contain up to 0.01, 0.02, 0.03, 0.04, 0.05, 0.06, 0.07, 0.08, 0.09, or 0.1 wt. % Pb, based on the total weight of the alloy.

The copper-based alloy may have a formula (I):

$$Cu_aSn_bZn_cM_d \quad (I)$$

where

M is at least one transition metal, metalloid, or alkali metal, a is any number between 0.50 and 0.93, b is any number between 0.00 and 0.07, and c is any number between 0.00 and 0.40, and d is any number between 0.01 to 0.40.

In the formula (I), M may be at least one element from the following Periotic Table of Elements groups: I.A, III. A, IV. A, V.A, VI.A, VI. B, VII. B, VIII. B. M may be a combination of more than two elements. M may be a combination of up to two, three, four, five, or six elements. M may be Sb, Te, Co, Rb, Mo, In, W, Tl, Al, Fe, Mn, Ni, Pb, Si, or their combination. M may be at least one of or a combination of at least two of Sb, Te, Co, Rb, Mo, In, W, or Tl. M may be a combination of Al, Ni, Si, and Fe.

In the formula (I), a may be about, at least about, or at most about 0.50, 0.51, 0.52, 0.53, 0.54, 0.55, 0.56, 0.57, 0.58, 0.59, 0.60, 0.61, 0.62, 0.63, 0.64, 0.65, 0.66, 0.67, 0.68, 0.69, 0.70, 0.71, 0.72, 0.73, 0.74, 0.75, 0.76, 0.77, 0.78, 0.79, 0.80, 0.81, 0.82, 0.83, 0.84, 0.85, 0.86, 0.87, 0.88, 0.89, 0.90, 0.91, 0.92, or 0.93. a may be any number between 0.50 and 0.93. a may be any range between two numerals disclosed herein.

In the formula (I), b may be about, at least about, or at most about 0.00, 0.01, 0.015, 0.02, 0.025, 0.03, 0.035, 0.04, 0.045, 0.05, 0.055, 0.06, 0.065, or 0.070. b may be any number between 0.00 and 0.07. b may be any range between two numerals disclosed herein.

In the formula (I), c may be about, at least about, or at most about 0.00, 0.01, 0.02, 0.03, 0.04, 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, or 0.40. c may be any number between 0.00 and 0.40. c may be any range between two numerals disclosed herein.

In the formula (I), d may be about, at least about, or at most about 0.01, 0.02, 0.03, 0.04, 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, or 0.40. d may be any number between 0.01 and 0.40. d may be any range between two numerals disclosed herein.

Non-limiting example alloys of formula (I) may include $Cu_{0.91}Sn_{0.06}Co_{0.04}$, $Cu_{0.92}Sn_{0.06}Rb_{0.03}$, $Cu_{0.92}Sn_{0.06}Mo_{0.02}$, $Cu_{0.92}Sn_{0.06}In_{0.02}$, $Cu_{0.93}Sn_{0.06}Sb_{0.02}$, $Cu_{0.93}Sn_{0.06}Te_{0.02}$, $Cu_{0.93}Sn_{0.06}W_{0.01}$, or $Cu_{0.93}Sn_{0.06}Tl_{0.01}$. Non-limiting example alloys of formula (I) may include $Cu_{0.57}Zn_{0.29}Al_{0.07}Ni_{0.04}Si_{0.02}Fe_{0.01}$ or $Cu_{0.57}Zn_{0.29}(AlNiSiFe)_{0.14}$.

The copper-based alloy may include, comprise, consist essentially of, or consist of at least about, more than about, or about 50 wt. % Cu, based on the total weight of the alloy; and a compound having a formula (II):

$$A_xB_y \quad (II),$$

where

A is Cu, Sn, or Zn,

B is Co, Cr, In, Mn, Mo, Ni, Rb, Sb, Te, or Ti, x is any number between 1 and 53, and y is any number between 1 and 16.

In the formula (II), B may be an element from the following Periotic Table of Elements groups: I.A, III. A, V.A, VI.A, IV. B, VI. B, VII. B, VIII. B. B may be a transition metal, metalloid, or alkali metal. B may be Co, In, or Ni.

In the formula (II), x may be about, at least about, or at most about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, or 53. x may be any number between 1 and 53. x may be any range between two numerals disclosed herein.

In the formula (II), y may be about, at least about, or at most about 1, 2, 3, 4, 5, 6, 7, 8, 9, 10, 11, 12, 13, 14, 15, or 16. y may be any number between 1 and 16. y may be any range between two numerals disclosed herein.

The compound may be an intermetallic compound. The alloy may include a compound of formula (II), at least one, one or more, or more than one compound of formula (II). The alloy may include a mixture of compounds of formula (II). The alloy may include 2, 3, 4, 5, 6, 7, 8, 9, 10, or more different compounds of formula (II), each in the same or different amount.

In a non-limiting example, the alloy may include different compounds of formula (II), each based on only one of Cu, Sn, or Zn. In a different embodiment, the alloy may include a first compound based on Cu, second compound based on Sn, and a third compound based on Zn. In a non-limiting example, the alloy may include more than one compound of formula (II), each having the same A or B. For example, all compounds of formula (II) may have B equal to Ni. In another example, some compounds of formula (II) may have B=Ni and other compounds of formula (II) may have B=Co. The ratio of the more than one compound of formula (II) in the alloy may be about, at least about, or at most about 1:1, 1:2, 1:3, 1:4, 1:5, 1:6, 1:7, 1:8, 1:1:1, 1:2:1, 1:2:2, 1:2:3, 1:5:7, or the like.

Non-limiting example alloys of formula (II) may include $Cu_7In$, $SnNi_3$, $Sn_4Ni_3$, $Sn_3Ni_4$, $Sn_2Ni_3$, $SnNi_3$, SnCo, $Sn_3Co$, $Zn_{53}Ni_{16}$, $Zn_{22}Ni_3$, $Zn_{11}Ni_2$, ZnNi, $Zn_{53}Co_7$, $Zn_{13}Co$, or $Zn_{11}Co_2$.

The alloy may include at least about 50 wt. % of Cu. The alloy may include about, at least about, or at most about 50 to 99, 52 to 80, or 54 to 70 wt. % of Cu, based on the total weight of the alloy. The alloy may include about, at least about, or at most about 50, 51, 52, 53, 54, 55, 56, 57, 58, 59, 60, 61, 62, 63, 64, 65, 67, 68, 69, 70, 71, 72, 73, 74, 75, 76, 77, 78, 79, 80, 81, 82, 83, 84, 85, 86, 87, 88, 89, 91, 92, 93, 94, 95, 96, 97, 98, or 99 wt. % Cu, based on total weight of the alloy.

The alloy may include about, at most about, or no more than about 50 wt. % of the one or more compounds of formula (II). The alloy may include about, at most about, or no more than about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 wt. % of the one or more compounds of formula (II).

The alloy of formulas (I) and/or (II) may further include an amount of elemental Cr, Mn, Ti, Ni, Co, or W, which may further increase corrosion resistance and/or wear resistance of the alloy. Cr, Mn, Ti, Ni, Co, or W may be dopants.

The alloy of formulas (I) and (II) may have $K_{VRH}$ value of about or at least about 70 to 304, 80 to 250, 90 to 200, or 100 to 164 GPa. The alloy of formulas (I) and (II) may have $K_{VRH}$ value of about or at least about 70, 75, 80, 85, 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245, 250, 255, 260, 265, 270, 275, 280, 285, 290, 295, 300, or 305 GPa. The bulk modulus value, $K_{VRH}$, correlates to wear resistance of the alloy.

The alloy of formula (I), (II), or their combination, may have hardness of about or at least about 200 to 525, 220 to 480, or 250 to 450 HB. The alloy of formula (I), (II), or their combination, may have hardness of about or at least about 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, 500, 510, 520, or 525 HB.

A hydraulics component or system may include a first alloy of formula (I), a second alloy of formula (II), or both. The hydraulics component or system may be an axial piston pump. The first and second alloys may be included in a ratio of about 1:1, 1:2, 1:3, 1:4, 1:5, 1:6, 1:7, 1:8, 1:9, 1:10, 1:15, 1:20, 1:25, 1:50, 1:75, 1:100 of the first alloy: the second alloy or the second alloy: the first alloy. The first and/or second alloy may be included as a single phase, phase separation, or precipitate.

A method of identifying the materials of formulas (I) and (II) is disclosed herein. The method is described below in the experimental section. The alloy of formulas (I) and (II) may be prepared by traditional methods used to prepare copper-based alloys such as bronze and brass, for example, by forming the metals in an alloy and casting them into ingots, then melting copper and adding the alloy into the melted copper. Other methods of producing the alloys of formulas (I) and (II) are contemplated.

EXPERIMENTAL SECTION

Examples 1-3

To identify viable candidate alloys, three different Cu-based alloys, Examples 1-3, were tested. The first alloy was Pb-containing HF2, typically including Pb (9-11 wt. %), Sn (9-11 wt. %), Cu (balance). For HF2, the following formula was used in Example 1: $Cu_{0.9}Sn_{0.06}Pb_{0.04}$. The second alloy was Pb-free KSH or KSH with reduced amount of Pb, typically including Cu (55-65 wt. %), Si (0.1-1.5 wt. %), Al (2.5-5 wt. %), Ni (2.5-4.5 wt. %), Fe (0.5-1.5 wt. %), Pb (<0.1 wt. %), Zn (balance). For KSH or Example 2, the following formula was used: $Cu_{0.57}Zn_{0.29}Al_{0.07}Ni_{0.04}Si_{0.02}Fe_{0.01}$. The third alloy was Bi-substituted CuSn10Bi3: Sn, typically including (9-11 wt. %), Bi (2.8-3.6 wt. %), Cu (balance). For the Bi-substituted CuSn10Bi3, Example 3, the following chemical formula was used: $Cu_{0.93}Sn_{0.06}Bi_{0.01}$.

(I) Thermodynamic Phase Stability

Chemical space of each tested alloy in contact with oxygen was analyzed to assess interaction of each alloy with air. The chemical space was identified using phase diagrams generated in publicly available database oqmd.org and density functional theory (DFT) calculations based on T=0K. All possible phases that can be formed in a respective alloy's chemical space were identified in the Tables 1-3 below.

(a) Chemical Space of Pb-containing HF2, Example 1

Figure 2A:
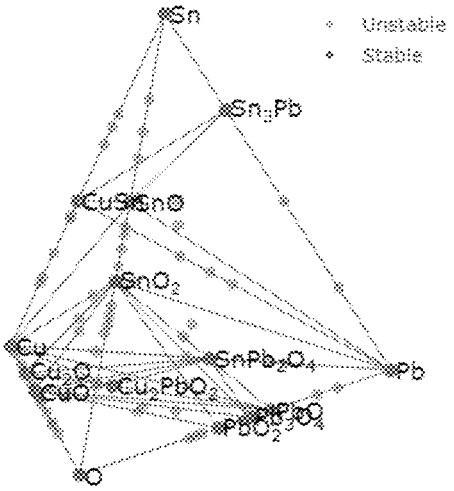
FIG. 2A is a 4D graph of Cu—Pb—Sn—O chemical space, relevant to Example 1 in contact with air (O)

A chemical space of Example 1 is a 4-dimensional chemical space of the three metal elements in contact with $O_2$. The 4-dimensional phase diagram, generated in publicly available database oqmd.org, depicting phase equilibria data is shown in FIG. 2A. The phase diagram shows stable compounds at T=0K as a dot and every line corresponds to two-phase equilibrium in the plot.

Since brass or bronze metal alloys may go through a heat treatment at high temperature, all compounds that may become stable up to 1,300° C. were analyzed. The list of the identified compounds that are relevant in the Cu—Pb—Sn—O chemical space of Example 1 is provided in Table 1. The stability of the identified compounds was categorized as a stable or nearly stable compound. Since the DFT calculation is based on T=0K thermodynamic, stable compound is based on T=0K stability. The "nearly stable" compounds were categorized as compounds that become stable near ambient temperature (temperature of up to 25° C.), or up to a temperature relevant to any metal heat treatment condition (the upper limit was set to up to 1,300° C.). Table 1 below shows all possible phases that may be formed in the Cu—Pb—Sn—O chemical space of Example 1, depending on the oxidizing/reducing condition and local concentration/segregation of elements in metal alloys.

TABLE 1

Stable and nearly-stable compounds in the Cu—Pb—Sn—O chemical space, relevant to Pb-containing HF2 bronze metal (Cu, Pb, Sn) of Example 1 and air (O)

| Classification | Stability | Compounds |
|---|---|---|
| Binary Oxides | Stable (T = 0 K) | $Cu_2O$, CuO, $Pb_3O_4$, PbO, $PbO_2$, SnO, $SnO_2$ |
| | Becomes stable (T = 1 K to 25° C.) | $Cu_4O_3$, $Pb_2O_3$, $CuO_2$ |
| | Becomes stable (up to 1,300° C.) | $Sn_2O_3$, $Cu_2O_3$, $Cu_8O$, $Cu_3O_4$, $PbO_3$ |
| Ternary oxide | Stable (T = 0 K) | $Cu_2PbO_2$, $SnPb_2O_4$ |
| | Becomes stable (T = 1 K to 25° C.) | $SnPbO_3$ |
| | Becomes stable (up to 1,300° C.) | $Cu_6PbO_8$, $CuPbO_3$, $Cu_2Pb_2O_5$ |
| Intermetallic | Stable (T = 0 K) | CuSn, $Sn_3Pb$ |
| | Becomes stable (T = 1 K to 25° C.) | $Cu_6Sn_5$, SnPb, $Cu_5Sn_4$, $Cu_3Sn$, $Cu_10Sn_3$ |
| | Becomes stable (up to 1,300° C.) | $SnPb_3$, CuSnPb |

The same analysis was conducted for the second and third Examples.

(b) Chemical space of Pb-free KSH or KSH with reduced amount of Pb, Example 2

Figure 2B:
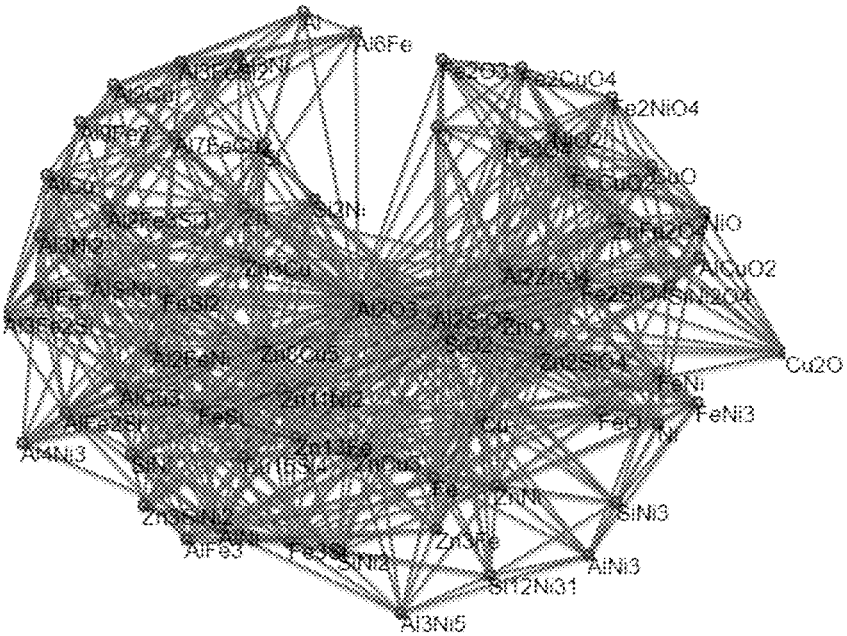
FIG. 2B is a 4D graph of Cu—Zn—Al—Ni—Si—Fe—O chemical space, relevant to Example 2 in contact with air (O)

The 7-dimensional chemical space of six metals (Cu, Zn, Al, Ni, Si, Fe) in contact with oxygen was generated, as was described above with respect to Example 1. FIG. 2B depicts the 7-dimensional phase diagram, which is instrumental in understanding interactions between KSR metal and air. Table 2 below summarizes the list of compounds that are relevant in this chemical space.

TABLE 2

Stable and nearly-stable compounds in Cu—Zn—Al—Ni—Si—Fe—O chemical space, relevant to KSH brass metal alloys of Example 2, in contact with $O_2$

| Classification | Stability | Compounds |
|---|---|---|
| Binary Oxides | Stable (T = 0 K) | $Al_2O_3$, $Cu_2O$, CuO, $Fe_2O_3$, $Fe_3O_4$, FeO, NiO, $NiO_2$, $SiO_2$, ZnO |
| | Becomes stable (T = 1 K to 25° C.) | $Cu_4O_3$, $CuO_2$ |

TABLE 2-continued

Stable and nearly-stable compounds in Cu—Zn—Al—Ni—Si—Fe—O chemical space, relevant to KSH brass metal alloys of Example 2, in contact with $O_2$

| Classification | Stability | Compounds |
|---|---|---|
| | Becomes stable (up to 1,300° C.) | $Cu_2O_3$, $Cu_8O$, $Fe_5O_8$, $Cu_3O_4$, $Al_5O_8$, $ZnO_2$, $FeO_2$, $Ni_2O_3$ |
| Ternary (or, higher) oxide | Stable (T = 0 K) | $Al_2SiO_5$, $Al_2ZnO_4$, $AlCuO_2$, $Fe_2CuO_4$, $Fe_2NiO_4$, $Fe_2SiO_4$, $FeCuO_2$, $SiNi_2O_4$, $Zn_2SiO_4$, $ZnFe_2O_4$ |
| | Becomes stable (T = 1 K to 25° C.) | $ZnFe_{16}Ni_7O_{32}$, $AlFeO_3$, $FeSiO_3$, $ZnFe_4NiO_8$, $AlFe_2O_4$, $FeNiO_2$, $FeNi_2O_4$, $Al_2Fe_3Si_3O_{12}$ |
| | Becomes stable (up to 1,300° C.) | $AlNi_2O_4$, $Fe_3Si_2O_8$, $Al_2Si_4O_{11}$, $Fe_5Si_3O_{12}$, $ZnSiO_3$, $CuNi_2O_4$, $ZnNi_2O_4$, $CuSiO_3$, $Al_2FeO_4$, $Al_2CuO_4$, $SiNiO_3$, $Al_2Zn_3Si_3O_{12}$, $ZnFeO_3$, $Al_2Si_3Ni_3O_{12}$, $Zn_2FeO_4$ |
| Binary Intermetallic | Stable (T = 0 K) | $Al_2Cu$, $Al_3Ni$, $Al_3Ni_2$, $Al_3N_{15}$, $Al_4N_{i3}$, $Al_6Fe$, $Al_9Fe_2$, AlCu, $AlCu_3$, AlFe, $AlFe_3$, AlNi, $AlNi_3$, $Cu_{15}Si_4$, $Fe_3Si$, FeNi, $FeNi_3$, FeSi, $FeSi_2$, $Si_{12}Ni_{31}$, $Si_2Ni$, SiNi, $SiNi_2$, $SiNi_3$, $Zn_{11}Ni_2$, $Zn_{13}Fe$, $Zn_3Cu$, $Zn_3Fe$, $Zn_8Cu_5$, $ZnCu_3$, ZnNi |
| | Becomes stable (T = 1 K to 25° C.) | ZnCu, $Fe_2Si$, $Si_2Ni_3$, $Zn_5Cu$, $ZnNi_3$, CuNi, $Cu_3Ni$, $Zn_3Ni$, $Al_8Fe_5$, $Fe_{11}Si_5$, $Zn_2Fe$, AlZn, $Cu_3Si$, $Zn_2Cu$, $Zn_2Ni$, $AlZn_3$, $Zn_4Cu_3$, ZnFe |
| | Becomes stable (up to 1,300° C.) | $Al_3Zn$, $CuNi_3$, $ZnFe_3$, $Al_3Cu_2$, $AlCu_4$, $Fe_5Si_3$, $Zn_4Fe_3$, $Al_2Cu_3$, $AlZn_5$, $Zn_5Ni$, $AlZn_2$, $Zn_4Ni_3$, $Al_3Zn_4$, $Fe_3Ni$, $Al_3Fe$, $Al_3Cu$, $Zn_5Fe$, $Al_3Si$, $Fe_3Cu$ |
| Ternary (or, higher) Intermetallic | Stable (T = 0 K) | $Al_2Fe_3Si_3$, $Al_2FeNi$, $Al_3Fe_2Si$, $Al_3FeSi_2$, $Al_7FeCu_2$, $AlFe_2Si$, AlSiNi, $Zn_3SiNi_2$ |
| | Becomes stable (T = 1 K to 25° C.) | $ZnCu_2Ni$, $AlZnNi_2$, $Al_2Fe_3Si_4$, $Al_2ZnCu_5$, $Zn_2CuNi$, $ZnCuNi_2$, $AlZnCu_2$, $Al_2CuNi$, $AlCuNi_2$ |
| | Becomes stable (up to 1,300° C.) | $Al_2FeCu$, $AlFe_2Ni$, $AlSiNi_2$, $Zn_2Cu_5Ni$, FeSiNi, $AlCu_2Ni$, AlZnCuNi, $Al_2Cu_5Ni$, $Fe_2SiNi$, AlCuSi, $ZnSiNi_2$, $AlFeNi_2$, $CuSiNi_2$, $Cu_2SiNi$, $ZnFeNi_2$, $AlFe_2Cu$, $Al_2FeCu_5$, $Al_2ZnFeCu_4$, $Al_2ZnCu_4Ni$, $AlZnFe_2$, $FeCuNi_2$, AlZnCu, $Zn_2FeCu_5$, $ZnCu_5Si_2$, $ZnFe_2Ni$, $FeSiNi_2$, ZnCuSi, AlZnFeNi, ZnFeCuNi, $Fe_2CuNi$, ZnSiNi, $Zn_2FeNi$, $Cu_5Si_2Ni$, $Al_2FeCu_4Ni$, $ZnFe_2Si$, ZnFeSiNi, $Zn_2FeCu_4Ni$, ZnCuSiNi, $ZnFe_2Cu$ |

(c) Chemical Space of Bi-substituted CuSn10Bi3, Example 3

Figure 2C:
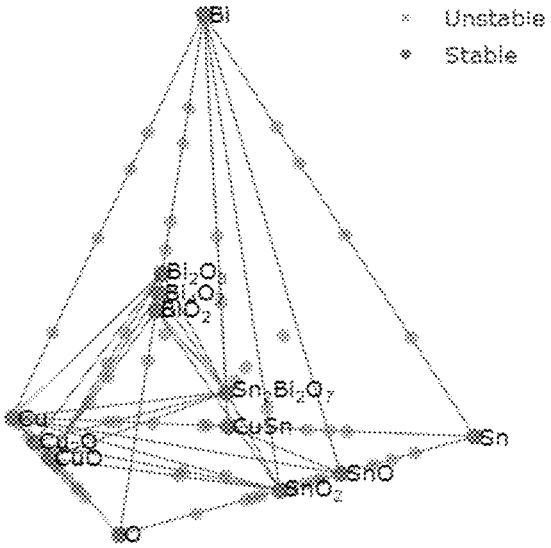
FIG. 2C is a 4D graph of Cu—Sn—Bi—O chemical space, relevant to Example 3 in contact with air (O)

The 4-dimensional chemical space of three metal elements (Cu, Sn, and Fe) in contact with oxygen was generated, as was described above with respect to Examples 1 and 2. FIG. 2C depicts the 4-dimensional phase diagram, which is instrumental in understanding interactions between the Bi-substituted CuSn10Bi3 metal of Example 3 and air. Table 3 below summarizes the list of compounds that are relevant in this chemical space.

TABLE 3

Stable and nearly-stable compounds in Cu—Sn—Bi—O chemical space, relevant to Bi-substituted brass metal (CuSn10Bi3) of Example 3 in contact with air ($O_2$)

| Classification | Stability | Compounds |
|---|---|---|
| Binary Oxides | Stable (T = 0 K) | $Bi_2O_3$, $Bi_4O_7$, $BiO_2$, $Cu_2O$, CuO, SnO, $SnO_2$ |
| | Becomes stable (T = 1 K to 25° C.) | $Cu_4O_3$, $CuO_2$ |
| | Become stable (up to 1,300° C.) | $Bi_{13}O_{20}$, $Sn_2O_3$, $Cu_2O_3$, $Cu_8O$, $Cu_3O_4$ |
| Ternary oxide | Stable (T = 0 K) | $CuBi_2O_4$, $Sn_2Bi_2O_7$ |
| | Becomes stable (T = 1 K to 25° C.) | N/A |
| | Becomes stable (up to 1,300° C.) | $CuBiO_3$ |
| Intermetallic | Stable (T = 0 K) | CuSn |
| | Becomes stable (T = 1 K to 25° C.) | $Cu_6Sn_5$, $Cu_5Sn_4$, $Sn_3Bi$, SnBi, $Cu_3Sn$, $Cu_{10}Sn_3$ |
| | Becomes stable (up to 1,300° C.) | CuBi, $SnBi_2$, $CuBi_2$, CuSnBi, $SnBi_3$ |

(II) Corrosion Resistance or $O_2$ Chemical Resistivity

Each Example was examined for chemical reactivity with $O_2$. For the analysis, "interface reactions" module kit, publicly available from materialsproject.org was used. The analysis focused on the reactions between the tested alloy and $O_2$ under the following conditions:

i) when a dilute amount of $O_2$ is present and ii) during the most thermodynamically-stable reaction pathway (i.e., at its minimum reaction enthalpy in 2D phase space between Cu-based metal alloy and $O_2$.

Figure 3:
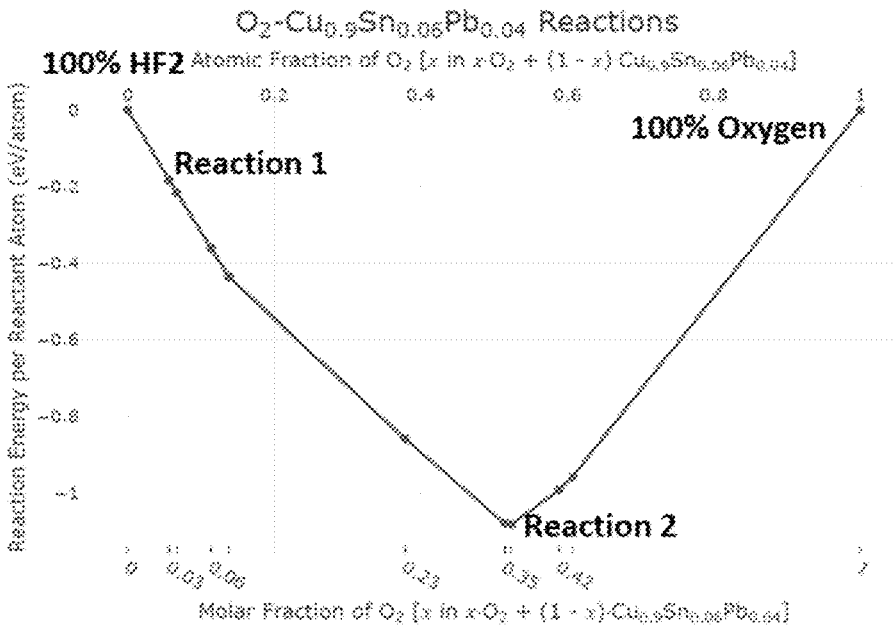
FIG. 3 is a phase diagram between $O_2$ gas and Example 1.

FIG. 3 shows a phase diagram generated between $O_2$ and Example 1. In FIG. 3, the molar fraction (x) indicates amount of $O_2$ and HF2 metal. For example, when x=0, it would be pure HF2 metal; and, when x=1, it would be 100% $O_2$ gas. As is apparent from FIG. 3, the very first decomposition reaction of the HF2 metal—denoted as Reaction 1 in FIG. 3—occurs at molar fraction x=0.029, where $0.029O_2$ and $0.971Cu_{0.9}Sn_{0.06}Pb_{0.04}$ react to form 0.874Cu, 0.039Pb, and 0.058SnO as decomposition products. In FIG. 3, reaction enthalpy ($E_{Rxn}$) for Reaction 1 is found between $O_2$ and HF2 metal to be −0.184 eV/atom.

tions may proceed at the minimum reaction enthalpy (i.e., most favorable condition). For all Cu alloy metals, comparison was made against HF2 at Reaction 1 and Reaction 2.

It is desirable that a Cu alloy metal reacts as little as possible with $O_2$. For example, if two $O_2$ molecules are reacting with one Cu alloy candidate and another Cu alloy composition can only react with one $O_2$ gas molecule, it is possible to conclude that the latter Cu alloy composition may provide twice the protection against oxidation when compared to the former composition, at identical corrosive conditions. Reaction enthalpy ($E_{rxn}$) describes how favorable a certain reaction is. Therefore, to make the Cu alloy oxidation decomposition reaction occur less favorably, reactions with higher values of $E_{rxn}$. were identified. For instance, when $E_{rxn}$ is −0.2 eV/atom, the corresponding decomposition reaction will be less favorable compared to the case when $E_{rxn}$ is found to be −0.4 eV/atom, which is desirable. Overall, the ideal Cu alloy candidate is a composition configured to react as little as possible with $O_2$ while having a relatively high $E_{rxn}$.

Tables 4 and 5 summarize the chemical reactivity of Examples 1, 2, 3 with $O_2$ gas at corresponding dilute amount of $O_2$ (i.e., Reaction 1) and the respective most stable thermodynamic reaction between $O_2$ gas and Cu metal alloy (i.e., Reaction 2 at $E_{rxn,min}$). In Tables 4 and 5, the molar ratio between $O_2$ and Cu alloy metal and its reaction enthalpy ($E_{rxn,dil.}$) are provided for each reaction.

TABLE 4

Chemical reactivity of Examples 1-3 against dilute amount of $O_2$ gas

| Example | Decomposition reaction at dilute concentration of $O_2$ | $O_2$/metal | $E_{rxn,dil.}$ [eV/atom] |
|---|---|---|---|
| 1 | $0.029\ O_2 + 0.971\ Cu_{0.9}Sn_{0.06}Pb_{0.04} \rightarrow 0.874\ Cu + 0.039\ Pb + 0.058\ SnO$ | 0.037 | −0.184 |
| 2 | $0.036\ O_2 + 0.964\ Al_{0.07}Zn_{0.29}Fe_{0.01}Cu_{0.57}Si_{0.02}Ni_{0.04} \rightarrow 0.035\ Zn_8Cu_5 + 0.01\ SiNi_2 + 0.01\ FeSi + 0.019\ AlNi + 0.024\ Al_2O_3 + 0.375\ Cu$ | 0.030 | −0.366 |
| 3 | $0.029\ O_2 + 0.971\ Cu_{0.93}Sn_{0.06}Bi_{0.01} \rightarrow 0.058\ SnO + 0.903\ Cu + 0.01\ Bi$ | 0.127 | −0.184 |

TABLE 5

Chemical reactivity of Examples 1-3, where $E_{rxn}$ is at minimum (i.e., most stable decomposition reaction)

| Example | Most stable oxidation reaction at $E_{rxn,min}$ | $O_2$/metal | $E_{rxn,min.}$ [eV/atom] | Final Evaluation |
|---|---|---|---|---|
| 1 | $0.355\ O_2 + 0.645\ Cu_{0.9}Sn_{0.06}Pb_{0.04} \rightarrow 0.026\ Cu_6PbO_8 + 0.039\ SnO_2 + 0.426\ CuO$ | 0.550 | −1.082 | Most protective vs. $O_2$ |
| 2 | $0.346\ O_2 + 0.654\ Al_{0.07}Zn_{0.29}Fe_{0.01}Cu_{0.57}Si_{0.02}Ni_{0.04} \rightarrow 0.373\ CuO + 0.013\ Zn_2SiO_4 + 0.023\ Al_2ZnO_4 + 0.003\ Fe_2NiO_4 + 0.141\ ZnO + 0.023\ NiO$ | 0.529 | −1.426 | Less protective than HF2 vs. $O_2$ (by ~30%) |
| 3 | $0.347\ O_2 + 0.653\ Cu_{0.93}Sn_{0.06}Bi_{0.01} \rightarrow 0.607\ CuO + 0.003\ Sn_2Bi_2O_7 + 0.033\ SnO_2$ | 0.531 | −1.065 | Similar to $HF_2$ |

The most stable reaction between two species takes places at Reaction 2 (i.e., minimum $E_{rxn}$). Evaluating Reaction 2 accounted for situations where both $O_2$ gas and Cu alloy metals are abundantly present, where decomposition reac- As can be seen in Tables 4 and 5, Examples 1 and 3 are similar in terms of oxidation corrosion tendency from evaluating the molar ratio and reaction enthalpy data. Example 3 may thus achieve similar oxidation resistance as the tested leaded bronze metal alloy of Example 1. In contrast, the brass alloy of Example 2 with Al, Z, Fe, Si, and Ni has a higher probability of succumbing to oxidation by about 30%, when compared to Example 1.

(III) Mechanical Properties

Mechanical properties of Examples 1-3 were measured and assessed.

Hardness is typically used in the field of wear resistance as the criteria for judging alloys, castings, hard-facings, and overlays. Typically, it is understood that the harder the material, the greater the wear resistance. Hardness of a material tends to also increase with an increase in the elastic modulus.

There are three different elastic moduli: Young's modulus, Shear modulus, and Bulk modulus. Young's modulus is a mechanical property that measures the stiffness of a solid material. It defines the relationship between stress (force per unit area) and strain (proportional deformation) in a material in the linear elasticity regime of a uniaxial deformation. Shear modulus is defined as the ratio of shear stress to the shear strain. The bulk modulus is an extension of Young's modulus to three dimensions.

Computed bulk modulus value was used as a key descriptor to correlate with wear resistance. A high bulk modulus, which is proportional to hardness, means greater wear resistance for the materials. Table 6 shows the average bulk modulus ($K_{VRH}$) values: i.e., average value of $K_R$ (bulk modulus Reuss—lower bound for polycrystalline material) and $K_V$ (bulk modulus Voigt—upper bound for polycrystalline material). The data was assessed using *Scientific Data*, 2:150009, DOI: 10.1038/sdata.2015.9 and materialsproject.org. As is apparent from Table 6, Bi has a bulk modulus value smaller than Pb, while many elements contained in KSH (Zn, Al, Si, Fe, and Ni) have higher bulk modulus values than Pb.

TABLE 6

Computed bulk modulus, $K_{VRH}$, for chemical elements in brass/bronze alloy metals of Examples 1-3

| Element | Ni | Fe | Cu | Si | Al | Zn | Sn | Pb | Bi |
|---|---|---|---|---|---|---|---|---|---|
| $K_{VRH}$ [GPa] | 198 | 192 | 145 | 83 | 83 | 67 | 38 | 37 | 29 |

Data retrieved from *Glass and Ceramics*, Vol. 76, Nos. 1-2, May, 2019 (Russian Original, Nos. 1-2, January-February, 2019) was used to confirm that materials with higher bulk modulus values tend to have better wear resistance.

TABLE 7

Computed bulk modulus, $K_{VRH}$, for various coatings tested in FIG. 1 of Glass and Ceramics.

| Sample No. in FIG. 1 | Materials | $K_{VRH}$ [GPa] | Wear Resistance in Glass and Ceramics, FIG. 1 |
|---|---|---|---|
| 8) | Diamond | 436 | Best |
| 5) | $TiO_2$ | 209 | $2^{nd}$ best |
| 4) | $B_4C$ | 227 | $3^{rd}$ |
| 2) | $Cr_2O_3$ | 203 | $4^{th}$ |
| 7) | TiN | 259 | $5^{th}$ |
| 3) | $Al_2O_3$ | 232 | $6^{th}$ |
| 6) | $ZrO_2$ | 183 | Worst |

The bulk modulus of each material of Table 7 was tested. A strong correlation between the bulk modulus and wear resistance was identified. For example, $ZrO_2$, which has the lowest $K_{VRH}$ value among tested sample leads to the worst wear resistance. A value of $K_{VRH}$>200 GPa correlates to good wear resistance.

Examples 1-3 were analyzed by computing $K_{VRH}$ values for each one of the Examples, but without including Cu, Sn, and Zn. The exclusion was done to provide understanding of an effect of secondary element(s), beside Cu and Sn in bronze and Cu and Zn in brass. Clearly, for Example 1, this translates into $K_{VRH}$ value of Pb; and, for Example 3, this is the same value of $K_{VRH}$ for Bi. In Table 8 below, it is clearly shown that Examples 1 and 3 have similar $K_{VRH}$ ranges, i.e., 29 and 37 GPa, respectively. In comparison, $K_{VRH}$ of Example 2 is higher due to higher $K_{VRH}$ values of Ni, Fe, Si, and Al. Hence, it was found that composition of Example 2 does not lead to apparent cracks.

TABLE 8

Computed $K_{VRH}$ values for Examples 1-3

| Example No. | Composition | Computed $K_{VRH}$ except Cu, Zn, Sn [GPa] | Note |
|---|---|---|---|
| 1 | $Cu_{0.9}Sn_{0.06}Pb_{0.04}$ | 37 | Pb |
| 2 | $Cu_{0.57}Zn_{0.29}Al_{0.07}Ni_{0.04}Si_{0.02}Fe_{0.01}$ | 123 | Ni, Fe, Si, Al |
| 3 | $Cu_{0.93}Sn_{0.06}Bi_{0.01}$ | 29 | Bi |

Hence, while Example 3 has similar corrosion resistance against $O_2$ (see Tables 4-5) as Example 1, Bi has lower bulk modulus value than Pb, among different chemical elements being examined, indicating elevated level of Bi brittleness, which may lead to cracking and material failure.

Figure 4A:
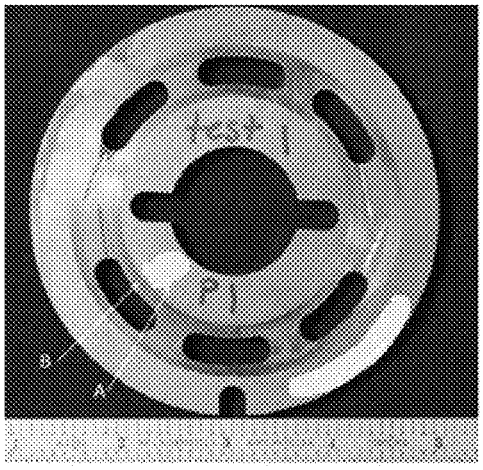
FIG. 4A shows a photograph of a distributor plate made from the alloy of Example 3 with cracks in area B.
Figure 4B:
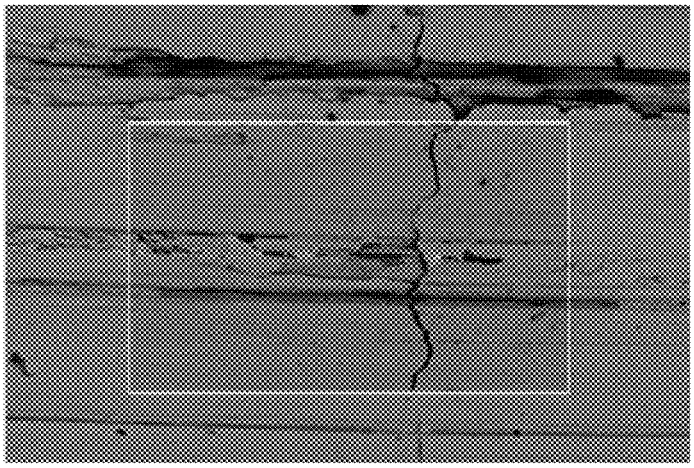
FIG. 4B shows a backscattered electron imaging (BEI) image of the area B shown in FIG. 4A with bright spots corresponding to Bi-rich precipitates.

The computed data was confirmed by observation of manufactured distributor plates made from materials of Examples 1-3. A distributor plate of Example 3 is shown in FIG. 4A. The same distributor plates were made for Examples 1 and 2. The distributor plate of Example 3 was observed to have several cracks in the Area B. FIG. 4B shows backscattered electron imaging (BEI) image with several bright spots corresponding to Bi-rich precipitates. BEI was used to direct the electron beam to area of interest near the cracks in the cladding in FIG. 4A. Backscattered electrons have the advantage that they are sensitive to the atomic mass of the nuclei they scatter from. As a result, heavier elements which backscatter more efficiently appear brighter than lighter elements in a BET image. Insoluble, brittle Bi impurity in Example 3 contributed to the mechanical failure in the fabricated distributor plate of Example 3. In contrast, a distributor plate made from the material of Example 2, where Pb is more soluble in the metal alloy, did not have any apparent cracks. Example 1 likewise did not exhibit any cracks during the testing.

$K_{VRH}$ values for more stable phase mixture were then calculated according to the analysis shown above. For example, in Example 2, $K_{VRH}$ values of $SiNi_2$, FeSi, and AlNi, that are 193, 211, and 162 GPa, respectively, were evaluated. It was assessed that the results from Tables 8 and 9 are consistent: i.e., Examples 1 and 3 have lower $K_{VRH}$ than Example 2. $K_{VRH}$ values for additional stable phase mixtures are provided in Table 9.

TABLE 9

Computed $K_{VRH}$ values for Cu-based alloys, based on decomposition reactions

| Example No. | Decomposition | $K_{VRH}$ except Cu-, Zn-, and Sn-containing species [GPa] | Note |
|---|---|---|---|
| 1 | 0.06 CuSn + 0.84 Cu + 0.04 Pb | 37 | Pb |
| 2 | 0.036 $Zn_8Cu_5$ + 0.05 $AlCu_3$ + 0.01 $SiNi_2$ + 0.01 FeSi + 0.02 AlNi + 0.239 Cu | 182 | $SiNi_2$, FeSi, AlNi |
| 3 | 0.06 CuSn + 0.87 Cu + 0.01 Bi | 29 | Bi |

A hardness range of Examples 1-3, measured experimentally and found in literature, is provided in Table 10. Lower $K_{VRH}$ correlates with lower hardness measurements.

TABLE 10

Measured hardness of Examples 1-3 in comparison to $K_{VRH}$ values of Tables 8 and 9

| Example No. | Hardness Range (HB) | $K_{VRH,exceptCu,Zn,Sn}$ in Table 8 [GPa] | $K_{VRH,exceptCu-,Zn-,Sn-}$ in Table 9 [GPa)] |
|---|---|---|---|
| 1 | 70-100 | 37 | 37 |
| 2 | 200-220 | 123 | 182 |
| 3 | 90-120 | 29 | 29 |

μm), a disk (~1 μm), a block (>1 μm), or a continuous block structure (~20 to 30 μm) in brass alloys.

Additional Examples

(IV) Brass/Bronze Materials Design and Discovery for Hydraulics

Since Bi was identified as a non-ideal candidate to replace Pb due to its brittleness, other elements were assessed for corrosion resistance against $O_2$ instead of Bi. Cu-based alloy with 3 wt. % dopant, 10 wt. % Sn, and balance Cu, similar to the $CuSn10Bi_3$ was chosen.

Since the atomic mass varies for different elements, the chemical formula that may vary from $Cu_{0.86}Sn_{0.05}M_{0.08}$—$Cu_{0.93}Sn_{0.06}M_{0.01}$ was investigated. The following chemical elements M: Mg, Al, Si, Ca, Sc, Ti, V, Cr, Mn, Fe, Co, Ni, Zn, Ga, Ge, Rb, Sr, Y, Zr, Nb, Mo, In, Sb, Te, Ba, La, Ce, Hf, Ta, W, Tl, Pb, and Bi were tested. $O_2$ gas reaction at the most stable thermodynamic reaction (@$E_{rxn}$) was examined. As is shown in Table 11, M=Ni, Sb, Te, Co, Rb, Mo, In, W, or Tl is more resistant against oxidation than Bi. Specifically, Ni, Sb, and Te were identified to be the most resistant elements against oxidation, when 3 wt. % was added to Cu—Sn bronze alloy metal system. Alkali metals were excluded due to their ductility.

TABLE 11

Chemical elements that are more resistant against oxidation than Pb and Bi

| Formula | Most Stable $O_2$ Reaction | $O_2$ per Brass | $E_{rxn}$ (eV/atom) | Note |
|---|---|---|---|---|
| $Cu_{0.91}Sn_{0.06}Co_{0.04}$ | 0.351 $O_2$ + 0.649 $Co_{0.04}Cu_{0.91}Sn_{0.06}$ → 0.009 $Co_3O_4$ + 0.039 $SnO_2$ + 0.59 CuO | 0.541 | −1.072 | Better than Bi |
| $Cu_{0.91}Sn_{0.06}Ni_{0.04}$ | 0.349 $O_2$ + 0.651 $Cu_{0.91}Ni_{0.04}Sn_{0.06}$ → 0.593 CuO + 0.039 $SnO_2$ + 0.026 NiO | 0.536 | −1.045 | Better than Pb |
| $Cu_{0.92}Sn_{0.06}Rb_{0.03}$ | 0.349 $O_2$ + 0.651 $Rb_{0.03}Cu_{0.92}Sn_{0.06}$ → 0.02 $RbCuO_2$ + 0.039 $SnO_2$ + 0.58 CuO | 0.536 | −1.071 | Better than Bi |
| $Cu_{0.92}Sn_{0.06}Mo_{0.02}$ | 0.355 $O_2$ + 0.645 $Cu_{0.92}Sn_{0.06}Mo_{0.02}$ → 0.013 $MoO_3$ + 0.594 CuO + 0.039 $SnO_2$ | 0.550 | −1.095 | Better than Bi |
| $Cu_{0.92}Sn_{0.06}In_{0.02}$ | 0.351 $O_2$ + 0.649 $In_{0.02}Cu_{0.92}Sn_{0.06}$ → 0.013 $In(Cu_3O_4)_2$ + 0.039 $SnO_2$ + 0.519 CuO | 0.541 | −1.082 | Better than Bi |
| $Cu_{0.93}Sn_{0.06}Sb_{0.02}$ | 0.355 $O_2$ + 0.645 $Cu_{0.93}Sn_{0.06}Sb_{0.02}$ → 0.006 $Cu(SbO_3)_2$ + 0.594 CuO + 0.039 $SnO_2$ | 0.550 | −1.083 | Better than Pb |
| $Cu_{0.93}Sn_{0.06}Te_{0.02}$ | 0.357 $O_2$ + 0.643 $Cu_{0.93}Sn_{0.06}Te_{0.02}$ → 0.013 $CuTeO_4$ + 0.585 CuO + 0.039 $SnO_2$ | 0.555 | −1.065 | Better than Pb |
| $Cu_{0.93}Sn_{0.06}W_{0.01}$ | 0.351 $O_2$ + 0.649 $Cu_{0.93}Sn_{0.06}W_{0.01}$ → 0.006 $WO_3$ + 0.604 CuO + 0.039 $SnO_2$ | 0.541 | −1.079 | Better than Bi |
| $Cu_{0.93}Sn_{0.06}Tl_{0.01}$ | 0.347 $O_2$ + 0.653 $Tl_{0.01}Cu_{0.93}Sn_{0.06}$ → 0.039 $SnO_2$ + 0.003 $Tl_2O_3$ + 0.607 CuO | 0.531 | −1.058 | Better than Bi |
| $Cu_{0.93}Sn_{0.06}Pb_{0.01}$ | 0.349 $O_2$ + 0.651 $Cu_{0.93}Sn_{0.06}Pb_{0.01}$ → 0.007 $Cu_6PbO_8$ + 0.039 $SnO_2$ + 0.567 CuO | 0.536 | −1.062 | Better than Bi |
| $Cu_{0.93}Sn_{0.06}Bi_{0.01}$ | 0.347 $O_2$ + 0.653 $Cu_{0.93}Sn_{0.06}Bi_{0.01}$ → 0.607 CuO + 0.003 $Sn_2Bi_2O_7$ + 0.033 $SnO_2$ | 0.531 | −1.065 | Reference |

In conclusion, it was found that while Bi helps improve corrosion resistance, Bi may not directly help with wear resistance because Bi segregates/precipitates and is brittle. The same is confirmed in literature such as Hsieh et al. which reported significant changes in the brass metal, when adding different Bi contents of 0.5, 1, and 1.5 wt. % (*Met. Mater. Int.,* 19, No. 6 (2013), pp. 117~31179). It is reported that Bi precipitation can lead to a discontinuous globular (<1

Fe, Al, Si, Mn, Zn, Ti, Sb, Cr, and Ni are comparable or cheaper than Bi in terms of elemental cost and abundance. Table 12 below shows the computed bulk modulus, $K_{VRH}$ values, for these elements. As was observed with respect to Example 2, Ni, Fe, Si, Al, and Zn and intermetallic compounds listed in Table 2 lead to enhanced wear resistance, having a very high $K_{VRH}$ value compared to Example 1 and Example 3.

TABLE 12

Computed bulk modulus, $K_{VRH}$, and hardness for practical chemical elements

| Element | Cr | Ni | Fe | Mn | Ti | Al | So | Zn | Sb |
|---|---|---|---|---|---|---|---|---|---|
| $K_{VRH}$ [GPa] | 259 | 198 | 182 | 180 | 113 | 83 | 83 | 67 | 36 |
| Hardness [HB]* | 332 | 208 | 145 | 58 | 212 | 73 | N/A | 122 | 87 |

*Collected from https://periodictable.com/Properties/A/BrinellHardness.v.log.wt.html; converted from MPa to HB Subsequently, it was determined that Ti may form a number of different intermetallic compounds with Cu, Sn, or Zn, that also have high $K_{VRH}$ values. In addition, Mn may form intermetallic compounds with Zn (for bronze alloys). There is no intermetallic compound for Cr, but Cr metal or $Cr_2O_3$, in which both materials have high $K_{VRH}$ values, may help increase wear resistance.

TABLE 13

List of stable intermetallic compounds in Cu—Sn—Zn—Cr—Mn—Ti chemical space

| Compounds | $K_{VRH}$ [GPa] | Note | Hardness [HB] |
|---|---|---|---|
| CuTi | 130 | Cu alloys | ~166-261[a] |
| $CuTi_2$ | 126 | | |
| $Cu_4Ti$ | 157 | | |
| $Cu_4Ti_3$ | 132 | | |
| $Sn_3Ti_2$ | 87 | Bronze alloy only | ~70-130[b] |
| $SnTi_2$ | 115 | | |
| $Sn_5Ti_6$ | 105 | | |
| $SnTi_3$ | 114 | | |
| $Sn_3Ti_5$ | 107 | | |
| $Zn_3Mn$ | 88 | Brass alloy only | ~70[c] |
| $Zn_{13}Mn$ | 80 | | |
| $Zn_{16}Ti$ | 79 | | ~74[d] |
| $Zn_{22}Ti_3$ | 84 | | |
| ZnTi | 115 | | |
| $ZnTi_2$ | 96 | | |
| $ZnTi_3$ | 111 | | |
| $Zn_3Ti$ | 96 | | |
| $Cu_2ZnTi$ | 129 | | |

[a]Estimated from Jun Ikeda et al., Precipitation Behavior and Properties of Cu—Ti Alloys with Added Nitrogen, MATERIALS TRANSACTIONS, Online ISSN: 1347-5320, based on Cu—Ti alloy
[b]Estimated from Haozhong Xiao et al., Microstructure and mechanical properties of vacuum brazed CBN abrasive segments with tungsten carbide reinforced Cu—Sn—Ti alloys, Ceramics International, Volume 45, Issue 9, 15 Jun. 2019, Pages 12469-12475, based on Cu—Sn—Ti alloy
[c]Chih-Ting Wu et al., Effects of Mn, Zn Additions and Cooling Rate on Mechanical and Corrosion Properties of Al—4.6Mg Casting Alloys, Materials (Basel). 2020 April; 13(8): 1983, Published online 2020 Apr. 24. doi: 10.3390/ma13081983, based on Zn—Mn—Al—Mg alloy
[d]Jixing Lin et al., A biodegradable Zn—1Cu—0.1Ti alloy with antibacterial properties for orthopedic applications, Acta Biomaterialia, Volume 106, 1 Apr. 2020, Pages 410-427, based on Cu—Zn—Ti alloy Additionally, some chemical elements that were predicted to enhance the atmospheric corrosion resistance in Table 14. Because relatively opposite behavior between oxidation and wear resistance properties was observed, Cu, Sn, Zn—M intermetallic compounds with high $K_{VRH}$ values, which may be useful with respect to both degradation modes, were investigated.

Pure elements such as Ni, Co, and W having high $K_{VRH}$ values were also found to be corrosion resistant. A number of different stable intermetallic compounds, including oxidant resistant Ni, Sb, Te, Co, Rb, Mo, In, W, and Tl, that may form a stable compound with Cu, Sn, Zn are identified in Table 14. The intermetallics may address both oxidation and wear resistance from materials perspective (top candidates are shown in bolded font in Table 14) when added to Cu-based alloys. Hardness ranges for elements and intermetallic compounds are listed in Table 14. Because hardness values are not available for all compounds, for unavailable compounds, values were estimated based on literature values.

TABLE 14

$K_{VRH}$ of elements that are predicted to be anti-corrosive against $O_2$

| Classification | Compounds | $K_{VRH}$ [GPa] | Wear resistance Prediction | Hardness [HB]** |
|---|---|---|---|---|
| Element | Ni | 198 | High | 208 |
| | Sb | 36 | Low | 87 |
| | Te | 22 | Low | 53 |
| | Co | 212 | High | 208 |
| | Rb | 4 | Low | 0.1 |
| | In | 44 | Low | 2.6 |
| | W | 304 | High | 763 |
| | Tl | 27 | Low | 7.8 |
| Cu alloy | CuTe | 15 | Low | — |
| | $Cu_7In$ | 120 | High | 452[a] |
| Bronze alloy only | $Sn_4Ni_3$ | 98 | High | |
| | $Sn_3Ni_4$ | 131 | High | ~60-270[b] |
| | $Sn_2Ni_3$ | 145 | High | |
| | $SnNi_3$ | 164 | High | |
| | SnTe | 40 | Low | — |
| | SnCo | 127 | High | ~360[c] |
| | $Sn_3Co$ | 78 | High | ~570[c] |
| | SnRb | 17 | Low | — |
| Brass alloy only | $Zn_{53}Ni_{16}$ | 110 | High | |
| | $Zn_{22}Ni_3$ | 92 | High | ~190-380[d] |
| | $Zn_{11}Ni_2$ | 99 | High | |
| | ZnNi | 146 | High | |
| | ZnSb | 48 | Low | — |
| | ZnTe | 46 | Low | — |
| | $Zn_{53}Co_7$ | 93 | High | |
| | $Zn_{13}Co$ | 85 | High | ~525[e] |
| | $Zn_{11}Co_2$ | 98 | High | |
| | $Zn_{13}Rb$ | 60 | Low | — |
| | $Zn_6Mo$ | 69 | Low | — |

**Elemental hardness is collected from Brinell Hardness of the elements, https://periodictable.com/Properties/A/BrinellHardness.v.log.wt.html
[a]Jin, Y., Cho, J., Park, D. et al. Manufacturing and Macroscopic Properties of Cold Sprayed Cu—In Coating Material for Sputtering Target. *J Therm Spray Tech* 20, 497-507 (2011). https://doi.org/10.1007/s11666-010-9552-6
[b]Scientific Letters of Rzeszow University of Technology, NR 293 (e-ISSN 2300-5211), Mechanika, Kwartalnik tom XXXIII zezyt 88 (nr 2/2016) kwiecień-czerwiec (Not exact composition, but Sn addition to Ni up to 12 wt. % Sn)
[c]Estimated from N. Tamura et al., Mechanical stability of Sn—Co alloy anodes for lithium secondary batteries, Electrochemical Acta, Volume 49, Issue 12, 15 May 2004, pp. 1949-1956, based on Sn—Co alloy
[d]Estimated from R. M. Gnanamuthu et al., Comparative study on structure, corrosion and hardness of Zn—Ni alloy deposition on AISI 347 steel aircraft material, Journal of Alloys and Compounds, Volume 513, 5 Feb. 2012, pp. 449-454 based on Zn—Ni alloy
[e]Estimated from Stone, H.E.N., The oxidation resistance and hardness of some intermetallic compounds. *J Mater Sci* 9, 607-613 (1974), based on Zn—Co alloy While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A wear resistant hydraulics system comprising:

a first copper-based alloy having a formula (I):

$$Cu_aSn_bZn_cM_d \quad (I)$$

where

M is a combination of up to six transition metals, metalloids, and/or alkali metals including Sb, Te, Co, Rb, In, Tl, Al, and/or Si, a is any number between 0.50 and 0.93, b is any number between 0.00 and 0.07, c is any number between 0.00 and 0.40, and d is any number between 0.01 and 0.40, and a second copper-based alloy comprising:

at least 50 wt. % of Cu, based on the total weight of the alloy; and at least one compound of formula (II):

$$A_xB_y \quad (II)$$

where

A is Cu, Sn, or Zn,

B is Co, Cr, In, Mo, Rb, Sb, Te, or Ti, x is any number between 1 and 53, and y is any number between 1 and 16, the first or second alloy having a bulk modulus $K_{VRH}$ value of about 70 to 304 GPa.

2. The hydraulics system of claim 1, wherein the first and/or second copper-based alloy is doped with Co or In.

3. The hydraulics system of claim 1, wherein c is 0.02.

4. The hydraulics system of claim 1, wherein B is Co, In, or Sb.

5. The hydraulics system of claim 1, wherein the first alloy has formula $Cu_{0.93}Sn_{0.06}Sb_{0.02}$.

6. The hydraulics system of claim 1, wherein the at least one compound of formula (II) is SnCo, $Sn_3Co$, $Cu_7In$, $Zn_{11}Co_2$, or $Zn_{53}Co_7$.

7. The hydraulics system of claim 1, wherein the hydraulics system comprises an axial piston pump.

8. The hydraulics system of claim 1, wherein the at least one compound of formula (II) includes Ti.

9. A wear resistant hydraulics system comprising:

a first copper-based alloy having a formula (I):

$$Cu_aSn_bZn_cM_d \quad (I)$$

where

M is a combination of up to six transition metals, metalloids, and/or alkali metals including Sb, Te, Co, Rb, Mo, In, W, Tl, Al, and/or Si, a is any number between 0.50 and 0.93, b is any number between 0.00 and 0.07, c is any number between 0.02 and 0.40, and d is any number between 0.01 and 0.40, and a second copper-based alloy comprising:

at least 50 wt. % of Cu, based on the total weight of the alloy; and at least one compound of formula (II):

$$A_xB_y \quad (II)$$

where

A is Cu, Sn, or Zn,

B is Co, Cr, In, Mn, Mo, Rb, Sb, Te, or Ti, x is any number between 1 and 53, and y is any number between 1 and 16.

10. The copper-based alloy of claim 9, wherein d is 0.02, c is 0.00, and M is In, Sb, or Te.

11. The copper-based alloy of claim 9, wherein M is a combination of at least two of Sb, Te, Co, Rb, In, or Tl.

12. The hydraulics system of claim 1, wherein A in formula (II) is Cu and B in formula (II) is Ti.

13. The hydraulics system of claim 9, wherein the first alloy has formula $Cu_{0.093}Sn_{0.06}Te_{0.02}$.

* * * * *